US012553183B2

(12) United States Patent
Miyauchi et al.

(10) Patent No.: US 12,553,183 B2
(45) Date of Patent: Feb. 17, 2026

(54) SHEET MANUFACTURING APPARATUS AND SHEET MANUFACTURING METHOD

(71) Applicant: SEIKO EPSON CORPORATION, Tokyo (JP)

(72) Inventors: Keisuke Miyauchi, Nagano (JP); Akira Hashimoto, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 212 days.

(21) Appl. No.: 18/479,140

(22) Filed: Oct. 2, 2023

(65) Prior Publication Data

US 2024/0110334 A1 Apr. 4, 2024

(30) Foreign Application Priority Data

Oct. 3, 2022 (JP) ..... 2022-159306

(51) Int. Cl.
*D21F 7/00* (2006.01)
*D21F 9/04* (2006.01)
*D21F 11/06* (2006.01)

(52) U.S. Cl.
CPC ..... *D21F 7/003* (2013.01); *D21F 9/04* (2013.01); *D21F 11/06* (2013.01)

(58) Field of Classification Search
CPC . D21F 7/003; D21F 9/04; D21F 11/06; D21F 9/00
See application file for complete search history.

(56) References Cited

U.S. PATENT DOCUMENTS

| | | | | |
|---|---|---|---|---|
| 11,174,594 | B2 * | 11/2021 | Gomi | D21B 1/08 |
| 11,193,238 | B2 * | 12/2021 | Oguchi | D21F 9/00 |
| 11,198,087 | B2 * | 12/2021 | Yamada | D21D 5/06 |
| 11,214,924 | B2 * | 1/2022 | Inagaki | F24F 6/12 |
| 2019/0309475 | A1 * | 10/2019 | Inagaki | D21G 9/0009 |
| 2020/0002894 | A1 * | 1/2020 | Higuchi | D04H 1/732 |
| 2020/0206668 | A1 * | 7/2020 | Miyazawa | B01D 45/14 |
| 2021/0107176 | A1 * | 4/2021 | Fukasawa | B27N 3/04 |
| 2021/0277602 | A1 * | 9/2021 | Oguchi | D04H 1/732 |

FOREIGN PATENT DOCUMENTS

| | | | | |
|---|---|---|---|---|
| EP | 4339344 | B1 * | 11/2024 | D21H 19/34 |
| JP | 2019-044284 | A | 3/2019 | |
| JP | 2022176652 | A * | 11/2022 | D21F 1/66 |
| JP | 7676882 | B2 * | 5/2025 | D21F 11/06 |

* cited by examiner

*Primary Examiner* — Jose A Fortuna
(74) *Attorney, Agent, or Firm* — Spencer Fane LLP

(57) ABSTRACT

There is provided a sheet manufacturing apparatus including: an accumulation section that accumulates a material containing fibers by an air flow to form a web; a transport section that transports the web in a first direction; a humidification section that humidifies the web; and a pressurization section that pressurizes the web humidified by the humidification section and compresses the web into a sheet shape, in which the humidification section includes an intake port that takes in air, a tank that stores water, a mist generation section that generates mist from the water, and an exhaust port that exhausts the mist and the air toward the web, and a position of the exhaust port is shifted in the first direction or a second direction opposite to the first direction with respect to a position of the tank.

6 Claims, 4 Drawing Sheets

SHEET MANUFACTURING APPARATUS AND SHEET MANUFACTURING METHOD

The present application is based on, and claims priority from JP Application Serial Number 2022-159306, filed Oct. 3, 2022, the disclosure of which is hereby incorporated by reference herein in its entirety.

BACKGROUND

1. Technical Field

The present disclosure relates to a sheet manufacturing apparatus and a sheet manufacturing method.

2. Related Art

In the related art, as described in JP-A-2019-44284, a sheet manufacturing apparatus including an accumulation section that accumulates a material containing fibers to form a web, a humidification section that humidifies the web, a transport section that transports the web, and a pressurization section that pressurizes the web, is known.

However, in the above-described sheet manufacturing apparatus, there is a concern about fibers and the like contained in the web being mixed into the water-storing part of the humidification section, and the generation of mold, germs, and the like is caused.

SUMMARY

There is provided a sheet manufacturing apparatus including: an accumulation section that accumulates a material containing fibers by an air flow to form a web; a transport section that transports the web in a first direction; a humidification section that humidifies the web; and a pressurization section that pressurizes the web humidified by the humidification section and compresses the web into a sheet shape, in which the humidification section includes an intake port that takes in air, a tank that stores water, a mist generation section that generates mist from the water, and an exhaust port that exhausts the mist and the air toward the web, and a position of the exhaust port is shifted in the first direction or a second direction opposite to the first direction with respect to a position of the tank.

There is provided a sheet manufacturing method including: accumulating a material containing fibers by an air flow to form a web; transporting the web in a first direction; humidifying the web; and pressurizing the humidified web and compressing the web into a sheet shape, in which when humidifying the web, air is taken in, mist is generated from water stored in a tank, and the mist and the air flow in the first direction or a second direction opposite to the first direction, and then flow in a third direction intersecting the first direction or the second direction to humidify the web.

DESCRIPTION OF EMBODIMENTS

1. Configuration of Sheet Manufacturing Apparatus

The configuration of a sheet manufacturing apparatus 1 according to the present embodiment will be described with reference to FIGS. 1 to 3.

The directions in each drawing will be described using a three-dimensional coordinate system. For convenience of description, the positive direction of the Z axis is referred to as an upward direction or simply upward, the negative direction of the Z axis is referred to as a downward direction or simply downward, the positive direction of the X axis is referred to as a right direction or simply right, the negative direction of the X axis is referred to as a left direction or simply left, the positive direction of the Y axis is referred to as a forward direction or simply forward, and the negative direction of the Y axis is referred to as a rearward direction or simply rearward.

Figure 1:
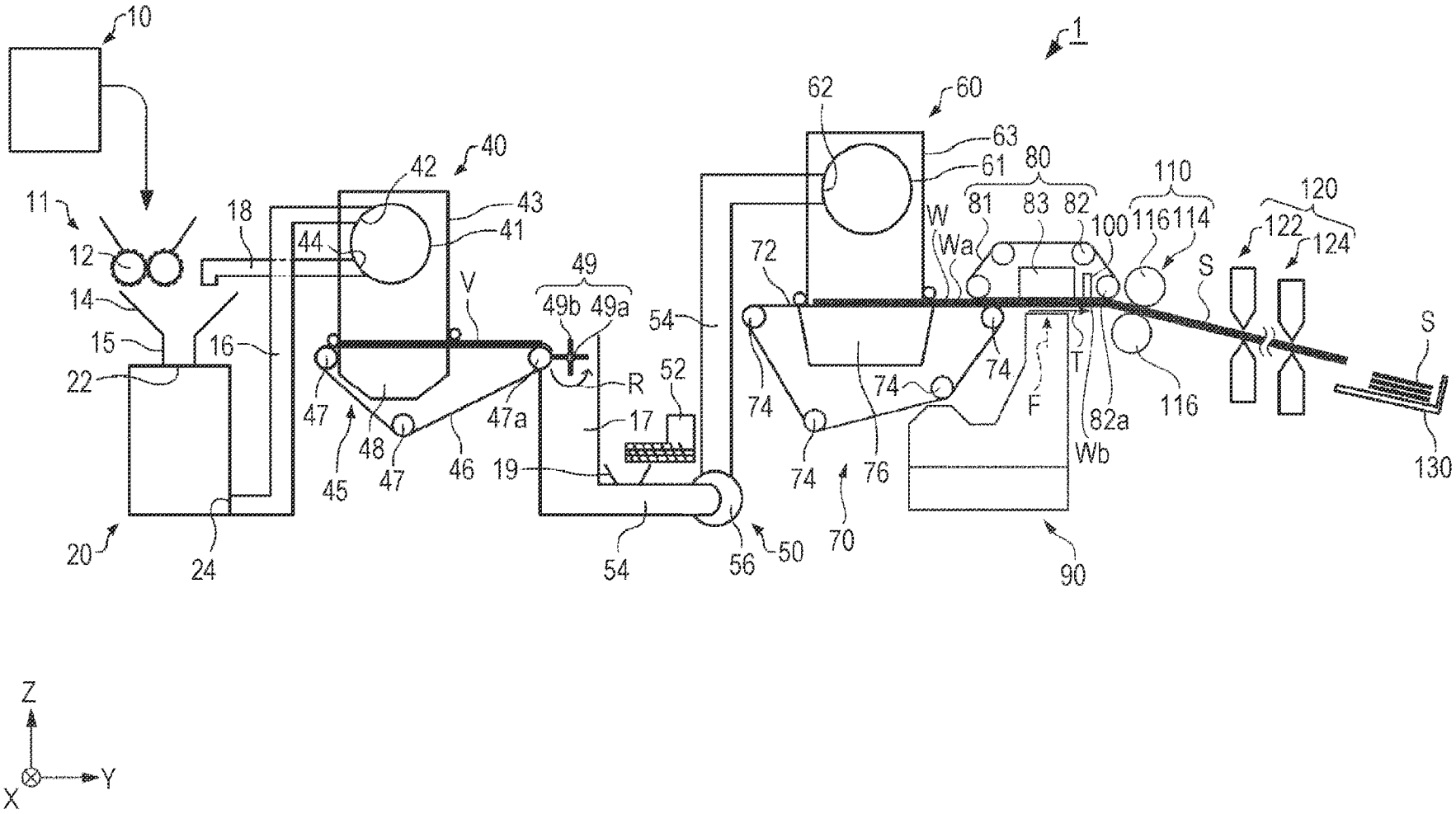
FIG. 1 is a schematic view illustrating a configuration of a sheet manufacturing apparatus.

As illustrated in FIG. 1, the sheet manufacturing apparatus 1 includes, for example, a supply section 10, a crushing section 11, a defibration section 20, a sorting section 40, a first web forming section 45, a rotating body 49, a mixing section 50, an accumulation section 60, a web transport section 80, a humidification section 90, an air ejection section 100, a sheet forming section 110, and a cutting section 120. The sheet manufacturing apparatus 1 is an apparatus for manufacturing a cut-form sheet S.

Further, the sheet manufacturing apparatus 1 includes a control section (not illustrated) that collectively controls each of the above sections. The control section includes a processor and a memory. The processor reads and executes the firmware stored in the memory and controls each section of the sheet manufacturing apparatus 1.

The supply section 10 supplies the raw material to the crushing section 11. The supply section 10 is, for example, an automatic charging section for continuously charging the raw material into the crushing section 11. The raw material supplied by the supply section 10 is a material containing various fibers.

The fiber is not particularly limited, and a wide range of fiber materials can be used. Examples of the fiber include natural fiber (animal fiber, plant fiber) and chemical fiber (organic fiber, inorganic fiber, and organic-inorganic composite fiber). More specifically, the fiber includes fibers made of cellulose, silk, wool, cotton, cannabis, kenaf, flax, ramie, jute, Manila hemp, sisal, coniferous tree, broadleaf tree, and the like, and these may be used alone, may be appropriately mixed and used, or may be used as a purified regenerated fiber.

Examples of the raw material of the fiber include pulp, used paper, and used cloth. Further, the fiber may be subjected to various surface treatments. Further, the material of the fiber may be a pure substance or a material containing a plurality of components such as impurities and other components. Further, as the fiber, a defibrated product obtained by defibrating used paper, pulp sheet, or the like by a dry method may be used.

The length of the fiber is not particularly limited, but in a case of one independent fiber, the length of the fiber in the longitudinal direction is 1 μm or more and 5 mm or less, preferably 2 μm or more and 3 mm or less, and more preferably 3 μm or more and 2 mm or less.

In the sheet manufacturing apparatus 1, as will be described later, moisture is applied to the web W in the humidification section 90, and thus the mechanical strength of the formed sheet S can be increased by using fibers having the ability to form hydrogen bonds. Examples of such fibers include cellulose. In the following, the application of moisture to the web W by the humidification section 90 is also referred to as humidification.

The fiber content in the sheet S is, for example, 50% by mass or more and 99.9% by mass or less, preferably 60% by mass or more and 99% by mass or less, and more preferably 70% by mass or more and 99% by mass or less. Such a content can be obtained by performing blending when forming the mixture.

The crushing section 11 cuts the raw material supplied by the supply section 10 into strips in the air such as the atmosphere. The shape and size of the strips are, for example, several centimeter square. The crushing section 11 has a crushing blade 12, and the charged raw material can be cut by the crushing blade 12. As the crushing section 11, for example, a shredder is used. The raw material cut by the crushing section 11 is received by a hopper 14 and then transferred to the defibration section 20 through a pipe 15.

The defibration section 20 defibrates the raw material cut by the crushing section 11. Here, "defibrating" means unraveling a raw material obtained by binding a plurality of fibers into each fiber. The defibration section 20 also has a function of separating substances (such as resin particles, ink, toner, and a blot inhibitor) adhering to the raw material from the fibers.

A product that passed through the defibration section 20 is referred to as "defibrated product". In addition to the unraveled fiber, the "defibrated product" may include resin particles separated from the fiber when the fiber is unraveled, coloring agents such as ink and toner, or additives such as blot inhibitors and paper strength enhancers. The shape of the unraveled defibrated product is a shape of a string. The unraveled defibrated product may exist in a state of not being entangled with other unraveled fibers, that is, in an independent state, or may exist in a state of being entangled with other unraveled defibrated products to form a mass shape, that is, in a state where a so-called lump is formed.

The defibration section 20 performs defibration by a dry method. Here, the treatment of defibrating or the like in the air such as the atmosphere, not in the liquid, is referred to as a dry method. As the defibration section 20, for example, an impeller mill is used. The defibration section 20 has a function of suctioning the raw material and generating an air flow that discharges the defibrated product. Accordingly, the defibration section 20 can suction the raw material together with the air flow from an introduction port 22 by the self-generated air flow, perform the defibration treatment, and transport the defibrated product to a discharge port 24. The defibrated product that passed through the defibration section 20 is transferred to the sorting section 40 through the pipe 16. As the air flow for transporting the defibrated product from the defibration section 20 to the sorting section 40, the air flow generated by the defibration section 20 may be used, or an air flow generation device such as a blower may be provided to use the air flow thereof.

The sorting section 40 introduces the defibrated product defibrated by the defibration section 20 from the introduction port 42 and sorts the defibrated products according to the length of the fibers. The sorting section 40 has, for example, a drum section 41 and a housing section 43 that accommodates the drum section 41 therein. As the drum section 41, for example, a sieve is used. The drum section 41 has a net, and can sort out fibers or particles smaller than the size of the mesh opening of the net, that is, a first sorted product passing through the net, and fibers, undefibrated pieces, and lumps larger than the size of the mesh opening of the net, that is, a second sorted product that does not pass through the net. For example, the first sorted product is transferred to the accumulation section 60 through a pipe 17. The second sorted product is returned from the discharge port 44 to the defibration section 20 through a pipe 18. Specifically, the drum section 41 is a cylindrical sieve that is rotationally driven by a motor (not illustrated). As the net of the drum section 41, for example, a wire net, an expanded metal obtained by stretching a metal plate having a cut, or a punching metal in which a hole is formed in the metal plate by a press machine or the like is used.

The first web forming section 45 transports the first sorted product that passed through the sorting section 40 to the pipe 17. The first web forming section 45 includes, for example, a mesh belt 46, a stretching roller 47, and a suction mechanism 48.

The suction mechanism 48 can suction the first sorted product, which is dispersed in the air passing through the opening of the sorting section 40, onto the mesh belt 46. The first sorted product is accumulated on the moving mesh belt 46 to form a web V. The web V is in a state before the binder described later is mixed.

The first sorted product that passed through the opening of the sorting section 40 is accumulated on the mesh belt 46. The mesh belt 46 is stretched by the stretching roller 47, and is configured such that the first sorted product is unlikely to pass therethrough and air is allowed to pass therethrough. The mesh belt 46 moves as the stretching roller 47 revolves. While the mesh belt 46 moves continuously, the first sorted product that passed through the sorting section 40 is continuously piled up, and accordingly, a web V is formed on the mesh belt 46.

The suction mechanism 48 is provided below the mesh belt 46. The suction mechanism 48 can generate a downward air flow. By the suction mechanism 48, the first sorted product dispersed in the air from the sorting section 40 can be suctioned onto the mesh belt 46. Accordingly, the discharge speed from the sorting section 40 can be increased.

The web V is formed in a soft and swollen state containing a large amount of air by passing through the sorting section 40 and the first web forming section 45. The web V accumulated on the mesh belt 46 is charged into the pipe 17 and transported to the accumulation section 60.

The rotating body 49 cuts the web V. In the example of FIG. 1, the rotating body 49 has a base portion 49*a* and a protrusion portion 49*b* protruding from the base portion 49*a*. The protrusion portion 49*b* has, for example, a plate-like shape. Four protrusion portions 49*b* are provided, and four protrusion portions 49*b* are provided at equal intervals. By rotating the base portion 49*a* in a direction R, the protrusion portion 49*b* can rotate around the base portion 49*a* as an axis. By cutting the web V by the rotating body 49, for example, the fluctuation of the fiber amount per unit time supplied to the accumulation section 60 can be reduced.

The rotating body 49 is provided in the vicinity of the first web forming section 45. In the example of FIG. 1, the rotating body 49 is provided in the vicinity of the stretching roller 47*a* positioned downstream in the path of the web V. The rotating body 49 is provided at a position where the protrusion portion 49*b* can come into contact with the web V and that does not come into contact with the mesh belt 46 on which the web V is accumulated. Accordingly, it is possible to suppress abrasion of the mesh belt 46 by the protrusion portion 49*b*. The shortest distance between the protrusion portion 49*b* and the mesh belt 46 is, for example, 0.05 mm or more and 0.5 mm or less. This is the distance at which the mesh belt 46 can cut the web V without being damaged.

The mixing section 50 mixes, for example, the first sorted product that passed through the sorting section 40 and the binder. The mixing section 50 has, for example, a binder supply section 52 that supplies the binder, a pipe 54 for transporting the first sorted product and the binder, and a blower 56. The binder is supplied from the binder supply section 52 to the pipe 54 through a hopper 19. The pipe 54 is coupled to the pipe 17.

In the mixing section 50, an air flow is generated by the blower 56, and the first sorted product and the binder can be transported while being mixed in the pipe 54. The mechanism for mixing the first sorted product and the binder is not particularly limited, and may be stirred by a blade that rotates at high speed, or may use rotation of a container such as a V-type mixer.

As the binder supply section 52, a screw feeder, a disc feeder, or the like is used.

The binder supplied from the binder supply section 52 is, for example, starch or dextrin. Starch is a polymer in which a plurality of a-glucose molecules are polymerized by glycosidic bonds. The starch may be linear or may contain branches.

As the starch, those derived from various plants can be used. Raw materials for starch include grains such as corn, wheat, and rice, beans such as broad beans, mung beans, and red beans, tubers such as potatoes, sweet potatoes, and tapioca, wild grasses such as Erythronium japonicum, bracken, and kudzu, and palms such as sago palm.

Further, processed starch or modified starch may be used as the starch. Examples of the processed starch include acetylated adipic acid cross-linked starch, acetylated starch, oxidized starch, octenyl succinate starch sodium, hydroxypropyl starch, hydroxypropylated phosphoric acid cross-linked starch, phosphorylated starch, phosphoric acid esterified phosphoric acid cross-linked starch, urea phosphorylated esterified starch, sodium starch glycolate, and high amylose corn starch. Further, as the dextrin that serves as the modified starch, those obtained by processing or modifying the starch can be preferably used.

In the sheet manufacturing apparatus 1, by using starch or dextrin as a binder, at least one of gelatinization of the binder and fiber-to-fiber hydrogen bonds occurs by being pressurized and heated after moisture is applied, and the sheet S can be given sufficient strength. Meanwhile, when the sheet S can be given sufficient strength only by the fiber-to-fiber hydrogen bonds, the sheet S can be manufactured without using a binder. In addition, when the sheet S is manufactured without using the binder, the sheet manufacturing apparatus 1 may not include the binder supply section 52.

The content of starch or dextrin in the sheet S is, for example, 0.1% by mass or more and 50% by mass or less, preferably 1% by mass or more and 40% by mass or less, and more preferably 1% by mass or more and 30% by mass or less. Such a content can be obtained by performing blending when forming the mixture.

In addition, in the binder supply section 52, in addition to the binder, in accordance with the type of the sheet S to be manufactured, a colorant for coloring the fibers, an aggregation inhibitor for suppressing coagulation of fibers or coagulation of binder, a flame retardant for making fibers and the like unlikely to burn, and the like, may be included. The mixture that passed through the mixing section 50 is transferred to the accumulation section 60 through the pipe 54.

The accumulation section 60 introduces the mixture that passed through the mixing section 50 from an introduction port 62, unravels the entangled fibers, and disperses the unraveled fibers in the air to make the product fall. Accordingly, the accumulation section 60 can uniformly accumulate the mixture on the second web forming section 70.

The accumulation section 60 has, for example, a drum section 61 and a housing section 63 that accommodates the drum section 61 therein. As the drum section 61, a rotating cylindrical sieve is used. The drum section 61 has a net and makes fibers or particles smaller than the size of the mesh opening of the net, which are contained in the mixture that passed through the mixing section 50, fall. The configuration of the drum section 61 is, for example, the same as the configuration of the drum section 41.

The "sieve" of the drum section 61 may not have a function of sorting a specific object. In other words, the "sieve" used as the drum section 61 means a sieve provided with a net, and the drum section 61 may make all of the mixture introduced into the drum section 61 fall.

The accumulation section 60 includes a second web forming section 70. The second web forming section 70 accumulates the mixture that passed through the drum section 61 to form a web W. The second web forming section 70 includes, for example, a first mesh belt 72, a stretching roller 74, and a suction mechanism 76.

The mixture that passed through the opening of the accumulation section 60 is accumulated on the first mesh belt 72. The first mesh belt 72 is stretched by the stretching roller 74, and is configured such that the mixture is unlikely to pass therethrough and air is allowed to pass therethrough. The first mesh belt 72 moves as the stretching roller 74 revolves. While the first mesh belt 72 moves continuously, the mixture that passed through the accumulation section 60 is continuously piled up, and accordingly, the web W is formed on the first mesh belt 72.

The suction mechanism 76 is provided below the first mesh belt 72. The suction mechanism 76 can generate a downward air flow. By the suction mechanism 76, the mixture dispersed in the air from the drum section 61 can be suctioned onto the first mesh belt 72. Accordingly, the discharge speed from the accumulation section 60 can be increased. Furthermore, the suction mechanism 76 can form a downflow in the falling path of the mixture, and can prevent the fibers and the binder from being entangled during the fall.

As described above, the accumulation section 60 can accumulate the material containing the fiber by the air flow to form the web W. By passing through the accumulation section 60, a binder is mixed with the fibers and the like, and the web W in a soft and swollen state containing a large amount of air is formed.

The web transport section 80, which is a transport section, is disposed downstream of the web W on the first mesh belt 72. The web transport section 80 transports the web W on the first mesh belt 72 in the transport direction T which is the first direction. Specifically, the web transport section 80 peels off the web W from the first mesh belt 72 and transports the web W toward the sheet forming section 110. In FIG. 1, the transport direction is the forward direction, and the direction opposite to the transport direction is the rearward direction.

Figure 2:
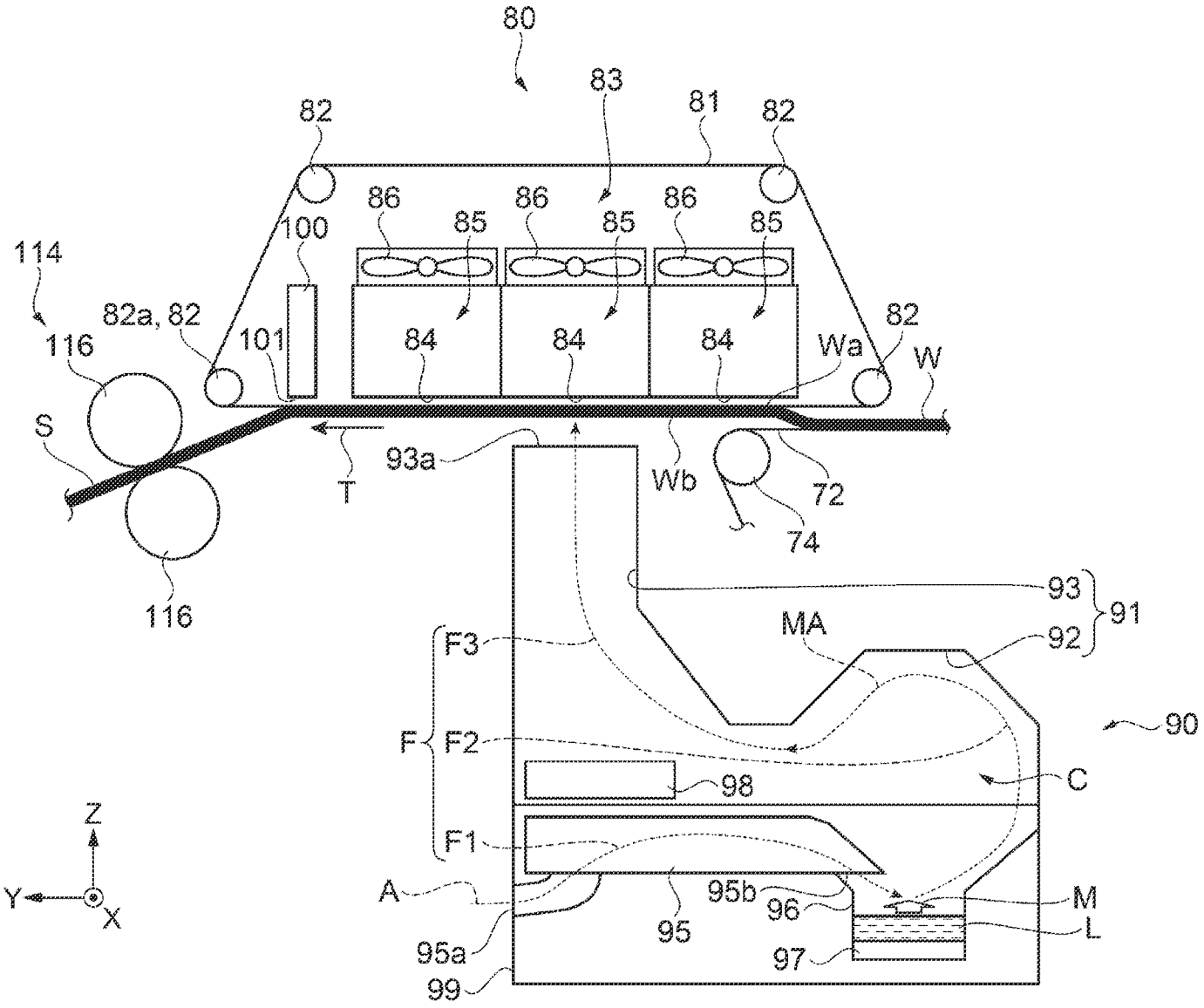
FIG. 2 is a partially enlarged view illustrating a configuration around a humidification section.

As illustrated in FIG. 2, the web transport section 80 includes a second mesh belt 81 as a transport belt, a plurality of rollers 82, and a suction mechanism 83 as a suction section. The second mesh belt 81 is stretched by the plurality of rollers 82 and is configured to allow mist and air, which will be described later, to pass therethrough. The second mesh belt 81 is configured to be rotationally driven by the revolution of the rollers 82.

The suction mechanism 83 is disposed at a position facing the web W from above with the second mesh belt 81 interposed therebetween. The suction mechanism 83 includes a plurality of intake fans 86, and uses the suction force of the intake fans 86 to generate an upward air flow in the second mesh belt 81 in contact with the web W. The web W is suctioned from above by this air flow.

More specifically, the suction mechanism 83 has a plurality of suction ports 84 for suctioning mist and air which will be described later. Further, the suction mechanism 83 has a suction duct 85 coupled to each of the plurality of suction ports 84.

The suction duct 85 is partitioned by a wall portion forming the suction port 84. The suction ducts 85 respectively coupled to the plurality of suction ports 84 can stabilize the suction amount with respect to the web W.

The web transport section 80 can peel off the web W from the first mesh belt 72, bring one surface Wa, which is the upper surface of the web W peeled off from the first mesh belt 72, into contact with the second mesh belt 81, and transport the web W in the transport direction T. The web W is transported in the transport direction T in a state where the one surface Wa is in contact with and held by the second mesh belt 81. At this time, the suction mechanism 83 can stably suction the web W from the one surface Wa via the second mesh belt 81.

Incidentally, although the configuration of the sheet manufacturing apparatus 1 is the same, for convenience of description, FIG. 2 illustrates the sheet manufacturing apparatus 1 in which the positive direction of the Y axis is reversed with respect to FIG. 1. That is, while FIG. 1 is a view of the sheet manufacturing apparatus 1 viewed from the left, FIG. 2 is a view of the humidification section 90 of the sheet manufacturing apparatus 1 viewed from the right. For example, while the transport direction T of the web W indicates the right with respect to the drawing in FIG. 1, the transport direction T indicates the left with respect to the drawing in FIG. 2. FIG. 3 also illustrates the humidification section 90 in the same direction as in FIG. 2.

As illustrated in FIG. 2, the lower portion of the humidification section 90 is covered with a case 99, and the upper portion is covered with a duct 91. The humidification section 90 includes an air intake port 95*a* which is an intake port, a tank 96, a piezoelectric vibrator 97 which is a mist generation section, and the duct 91. The duct 91 has an exhaust port 93*a*.

The configuration of the humidification section 90 will be described from upstream to downstream of a flow path F with reference to FIG. 2. The flow of the air A or the like along the flow path F in the humidification section 90 is generated based on the suction force by the suction mechanism 83 positioned in the upward direction of the humidification section 90. Further, the flow path F includes an air flow path F1, a first flow path F2, and a second flow path F3 from upstream to downstream.

The air duct 95 takes in the air A from the air intake port 95*a*, makes the air A flow along the air flow path F1 in the direction opposite to the transport direction T of the web W, and exhausts the air A from the air exhaust port 95*b*. The air intake port 95*a* is opened on the front surface of the case 99 such that the air A can flow smoothly in the direction opposite to the transport direction T. The direction opposite to the transport direction T of the web W is the second direction. That is, the second direction is the direction opposite to the first direction.

The tank 96 can store water L. The air A exhausted from the air exhaust port 95*b* flows toward the water surface of the water L stored in the tank 96. The air exhaust port 95*b* is opened below the rear part of the air duct 95 to make the air A flow smoothly toward the water surface of the water L of the tank 96.

The piezoelectric vibrator 97 that generates mist M from the water L is disposed at the bottom portion of the tank 96. The piezoelectric vibrator 97 is driven and vibrates, ultrasonic waves are generated in the water L, and the mist M is generated from the water L. The generated mist M rises from the water surface of the water L in the tank 96. The specific configuration for generating the mist M does not have to be an ultrasonic method such as the piezoelectric vibrator 97, and may be, for example, a steam type, a vaporization type, a warm air vaporization type, or the like.

The mist M rising from the water surface of the water L in the tank 96 rides on the air A flowing toward the water surface of the water L from the air exhaust port 95*b*, and is in a state where the air A and the mist M are included. Hereinafter, the air containing the air A and the mist M is referred to as humidified air MA.

The duct 91 through which the humidified air MA passes is provided between the tank 96 and the exhaust port 93*a*. The duct 91 includes a first duct 92 forming the first flow path F2 and a second duct 93 forming the second flow path F3.

The first duct 92 is provided above the tank 96 and extends in the transport direction T of the web W. The second duct 93 is provided between the first duct 92 and the exhaust port 93*a*, and extends in a direction intersecting the transport direction T of the web W. It should be noted that the direction intersecting the transport direction T of the web W or the direction opposite to the transport direction T is the third direction. That is, the third direction is a direction intersecting the first direction or the second direction. Further, the transport direction T of the web W and the direction opposite to the transport direction T are, for example, horizontal directions. The direction intersecting the transport direction T of the web W is, for example, a vertical direction.

The first duct 92 has a shape that swells above the tank 96 upstream of the first flow path F2, and has a shape that goes toward the second duct 93 in the transport direction T of the web W downstream of the first flow path F2. The first duct 92 has a shape such that the height becomes lower toward the second duct 93. Due to such a shape, the first duct 92 forms a chamber C above the tank 96.

The humidified air MA goes upward along the wall of the first duct 92 from the water surface of the water L of the tank 96, and then bends while being spirally wound in the chamber C of the first duct 92, and flows along the first flow path F2 in the transport direction T. When the humidified air MA is spirally wound in the chamber C, the flow speed is particularly high.

As described above, at least the direction of a part of the first flow path F2 of the first duct 92 is the transport direction T and is opposite to the direction of the air flow path F1.

Next, the humidified air MA is made to flow from the first flow path F2 going in the transport direction T along the second flow path F3 going in the upward direction, which is the direction intersecting the transport direction T, while changing the direction, by the second duct 93 coupled to the first duct 92.

The humidified air MA is exhausted from the exhaust port 93*a* formed above the second duct 93 toward the web W above.

The humidification section 90 is positioned below the web transport section 80. The exhaust port 93*a* of the humidification section 90 is provided at a position facing the web transport section 80 from below. Specifically, the exhaust port 93*a* is disposed, via the web W, to face the second mesh belt 81 of the web transport section 80.

As a result, the humidification section 90 can exhaust the humidified air MA from the exhaust port 93*a* toward the other surface Wb of the web W. The humidified air MA exhausted from the exhaust port 93*a* can be humidified from the other surface Wb of the web W in which one surface Wa is in contact with the second mesh belt 81.

In this manner, the humidification section 90 positioned below the web transport section 80 can humidify the web W by exhausting the humidified air MA from below the web W through the exhaust port 93*a* formed at the upper end of the second duct 93. Therefore, even when dew condensation occurs in or in the vicinity of the humidification section 90, the water droplets do not fall on the web W.

As a result, it is possible to suppress the non-uniform humidification of the web W, and it is possible to suppress the influence on the quality of the sheet S.

The water content of the web W humidified in the humidification section 90 is preferably 12% by mass or more and 40% by mass or less. With the specified water content of the web W, the humidification section 90 can effectively form the fiber-to-fiber hydrogen bonds and can increase the strength of the sheet S.

Incidentally, the web W is in a state before being clamped, such as being pressurized or heated by the sheet forming section 110 to be described later, and is in a state of containing a large amount of air and swelling softly. A material containing fibers may be separated from the web W, and fall or float.

The web W humidified by the humidification section 90 is suctioned from above by the suction mechanism 83 and is transported by the web transport section 80 while coming into contact with the second mesh belt 81. At this time, the web W is in a state where there is nothing to support from below. Therefore, the fiber or the like may be separated from the web W, and fall or float.

The falling or floating fibers and the like may enter the humidification section 90 through the exhaust port 93*a*. When fibers and the like enter the humidification section 90, reach the tank 96, and are mixed in the water L, the generation of mold, germs, and the like is caused.

As described above, in the present embodiment, the duct 91 including the first duct 92 and the second duct 93 is provided between the tank 96 and the exhaust port 93*a*. The first duct 92 is provided above the tank 96 and extends in the transport direction T of the web W. The second duct 93 is provided between the first duct 92 and the exhaust port 93*a*, and extends in a direction intersecting the transport direction T of the web W.

As a result, as illustrated in FIG. 2, the position of the exhaust port 93*a* is shifted in the transport direction T with respect to the position of the tank 96. The fibers and the like that enter the humidification section 90 from the exhaust port 93*a* fall to the lower portion of the second duct 93 against the upward flow of the humidified air MA of the second flow path F3.

Since the position of the exhaust port 93*a* is shifted in the transport direction T with respect to the position of the tank 96, there is no concern about fibers and the like that enter from the exhaust port 93*a* directly falling into the tank 96. Further, when the fibers and the like fall against the flow of the second flow path F3 of the humidified air MA, the fibers and the like are humidified by the humidified air MA. The fallen fibers and the like contain moisture and become heavy, and the movement of the fibers and the like to the tank 96 in the direction opposite to the transport direction T is further suppressed by sticking to the lower portion of the second duct 93 or the like.

In addition, the first duct 92 has a flow in the first flow path F2 in which the humidified air MA goes in the transport direction T. The flow of the first flow path F2 is in the direction opposite to the direction in which the fibers and the like that fell to the lower portion of the second duct 93 go toward the tank 96. The flow of the first flow path F2 can suppress movement of fibers and the like toward the tank 96.

As a result, the humidification section 90 can suppress the fibers and the like from reaching the tank 96 and being mixed into the water L, and can suppress the generation of mold, germs, and the like in the tank 96.

As illustrated in FIG. 2, the humidification section 90 may have a tray 98 positioned below the second duct 93. Specifically, the tray 98 is disposed in the humidification section 90 to face the exhaust port 93*a* and the web transport section 80 via the second duct 93.

The fibers and the like that fall from the exhaust port 93*a* and enter the humidification section 90 pass through the second duct 93, are received by the tray 98, and are captured. The fibers and the like are captured by the tray 98, and suppressed from reaching the tank 96.

The tray 98 can be taken out from the sheet manufacturing apparatus 1, and fibers and the like accumulated in the tray 98 can be removed.

Figure 3:
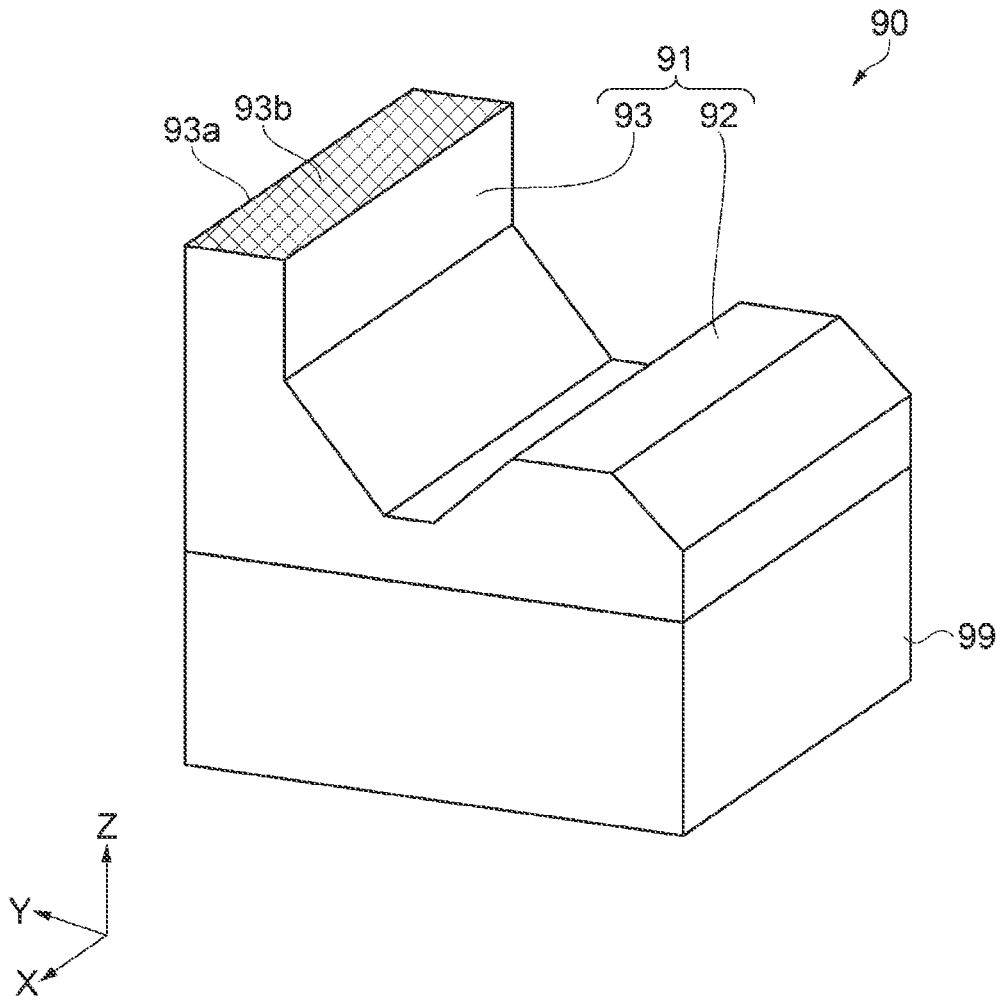
FIG. 3 is a perspective view illustrating the humidification section.

As illustrated in FIG. 3, the exhaust port 93*a* of the humidification section 90 has a rectangular shape. The exhaust port 93*a* is covered with a mesh surface 93*b* made of a wire net such as aluminum. The mesh surface 93*b* can suppress the entry of fibers and the like into the exhaust port 93*a*.

Here, the suction mechanism 83 will be described in more detail. The suction mechanism 83 is disposed at a position facing the humidification section 90 with the second mesh belt 81 interposed therebetween. The suction port 84 of the suction mechanism 83 and the exhaust port 93*a* of the humidification section 90 are disposed to face each other. Then, the suction duct 85 suctions the humidified air MA exhausted from the exhaust port 93*a* of the humidification section 90. In this manner, the humidified air MA exhausted from the exhaust port 93*a* is suctioned through the suction duct 85 from the suction port 84 disposed facing the exhaust port 93*a*. Since the humidified air MA is suctioned into the suction port 84 via the web W, the moisture content in the thickness direction of the web W can be made uniform.

Further, the plurality of suction ports 84 are coupled to the corresponding suction ducts 85, and can function independently of each other. The suction mechanism 83 can keep the air volume of the humidified air MA passing through the web W directly above the exhaust port 93*a* constant. As a result, the moisture content of the web W in the thickness direction is made uniform, variations in strength of the sheet S are suppressed, and the quality of the sheet S can be ensured.

In addition, the suction duct 85 can bring the web W into close contact with the second mesh belt 81 by taking in air. Therefore, the suction mechanism 83 has a function of peeling the web W off from the first mesh belt 72 and adsorbing the web W to the second mesh belt 81.

The humidification sections 90 illustrated in FIGS. 1 to 3 may be configured to be symmetrical with respect to the front-rear direction. That is, the tank 96 may be configured to be disposed in the forward direction of the exhaust port 93*a*.

In this case, the air intake port 95*a* is opened on the rear surface of the case 99. The air duct 95 takes in the air A from the air intake port 95*a*, makes the air A flow along the air flow path F1 going in the transport direction T of the web W, and exhausts the air A from the air exhaust port 95*b* to the tank 96 positioned in front of the inside of the case 99. The mist M is generated from the water L stored in the tank 96 by the piezoelectric vibrator 97 positioned in front of the inside of the case 99.

In addition, the first duct 92 extends in the direction opposite to the transport direction T of the web W. At least a direction of a part of the first flow path F2 formed by the first duct 92 is the direction opposite to the transport direction T.

The second duct 93 coupled to the first duct 92 extends in a direction intersecting the direction opposite to the transport direction T of the web W. The humidified air MA is made to flow along the second flow path F3 going in the upward direction, which is the direction intersecting the direction opposite to the transport direction T, while changing the direction, by the second duct 93.

Even when the humidification section 90 is configured to be symmetrical in the front-rear direction, the humidified air MA is exhausted upward from the exhaust port 93*a* formed above the second duct 93, and the web W can be humidified.

Further, the position of the exhaust port 93*a* is shifted in the direction opposite to the transport direction T with respect to the position of the tank 96. As a result, the humidification section 90 can suppress the fibers and the like from reaching the tank 96 and being mixed into the water L, and can suppress the generation of mold, germs, and the like in the tank 96.

Next, as illustrated in FIG. 1, the sheet forming section 110 is disposed downstream in the transport direction T of the web transport section 80 and the humidification section 90. The humidified web W is transported to the sheet forming section 110.

The air ejection section 100 is provided at the end portion of the web transport section 80 positioned on the sheet forming section 110 side. The air ejection section 100 ejects the compressed air to the web W.

As illustrated in FIG. 2, the air ejection section 100 is provided at a position adjacent to an outlet side roller 82*a* provided at the position closest to the sheet forming section 110 among the plurality of rollers 82 in the web transport section 80. More specifically, the air ejection section 100 is disposed between the downstream end portion of the suction mechanism 83 in the transport direction T and the outlet side roller 82*a*. As a result, the web W can be efficiently peeled off from the second mesh belt 81.

The air ejection section 100 includes a compression section (not illustrated) that compresses the air and a nozzle 101 that exhausts the compressed air. The nozzle 101 is provided at a position adjacent to the outlet side roller 82*a* and facing the second mesh belt 81. As a result, the web W peeled off from the second mesh belt 81 can be transported to the sheet forming section 110.

The nozzle 101 has an elongated opening. Then, the nozzle 101 ejects the compressed air to the one surface Wa of the web W that is in contact with the second mesh belt 81.

Since moisture is applied to the web W transported while being in contact with the second mesh belt 81 of the web transport section 80 by the humidification section 90, the adhesive force with respect to the second mesh belt 81 is increased, and the web W is stuck to the second mesh belt 81. When the web W is not peeled off from the second mesh belt 81 only by gravity, the web W is not smoothly transported to the sheet forming section 110, resulting in poor transport of the web W or damage to the web W.

According to the present embodiment, the second mesh belt 81 is pressed downward by ejecting the compressed air toward the web W before the sheet forming section 110 in the transport direction T. As a result, the web W is peeled off from the second mesh belt 81, and the web W can be smoothly delivered to the sheet forming section 110. Therefore, it is possible to suppress poor transport of the web W or damage to the web W.

The sheet forming section 110, which is a pressurization section, can form the sheet S compressed into a sheet shape by pressurizing the web W that was humidified and peeled off from the second mesh belt 81.

The sheet forming section 110 may be configured to perform at least one of heating and pressurizing treatment. The sheet forming section 110 can form the sheet S by performing at least one of heating and pressurizing treatment.

By performing at least one of the heating and pressurizing treatment, the sheet forming section 110 can bind a plurality of fibers to each other via a binder to form the sheet S compressed into a sheet shape.

For example, the sheet forming section 110 of the present embodiment is configured to pressurize and heat the humidified web W at the same time. Accordingly, the moisture contained in the web W evaporates after the temperature rises, and the thickness of the web W becomes thin to increase the fiber density.

The temperature of the moisture and the binder rises due to heat, the fiber density increases due to the pressure, and accordingly, the binder is gelatinized, and then the moisture evaporates to bind the plurality of fibers to each other via the gelatinized binder. Furthermore, the moisture evaporates due to heat and the fiber density increases due to the pressure, and accordingly, the plurality of fibers are bound to each other by hydrogen bonds. Accordingly, it is possible to form the sheet-shaped sheet S having better mechanical strength. The sheet S formed by the sheet forming section 110 has a continuous sheet shape.

Specifically, the sheet forming section 110 of the present embodiment includes a pressurizing heating section 114 that pressurizes and heats the web W. The pressurizing heating section 114 can be configured by using, for example, a heating roller or a heat press molding machine. The pressurizing heating section 114 includes a pair of heating rollers 116.

In the pair of heating rollers 116, the web W is heated to have a temperature of 60° C. or higher and 100° C. or lower. Further, the pair of heating rollers 116 applies pressure to the web W to thin the web W and increase the fiber density in the web W. The pressure applied to the web W is preferably 0.1 Mpa or more and 15 Mpa or less, more preferably 0.2 Mpa or more and 10 Mpa or less, and further preferably 0.4 Mpa or more and 8 Mpa or less.

Within such a pressure range, deterioration of fibers can be suppressed, and the sheet S having good strength can be manufactured again using a defibrated product obtained by defibrating the manufactured sheet S as a raw material.

The number of pairs of heating rollers 116 is not particularly limited. The pair of heating rollers 116 can simultaneously pressurize and heat the web W. Further, the configuration of the sheet manufacturing apparatus 1 can be simplified.

Further, the sheet forming section 110 may include a pressure roller and a transport belt (for example, a mesh belt).

As illustrated in FIG. 1, the cutting section 120 cuts a continuous sheet-shaped sheet S. The cutting section 120 includes a first cutting section 122 that cuts the sheet S in the direction intersecting the transport direction T of the sheet S, and a second cutting section 124 that cuts the sheet S in the direction parallel to the transport direction T. For example, the second cutting section 124 cuts the sheet S that passed through the first cutting section 122.

As a result, a cut-form sheet S having a predetermined size is manufactured. The cut cut-form sheet S is discharged to a discharge receiving section 130.

2. Sheet Manufacturing Method

Figure 4:
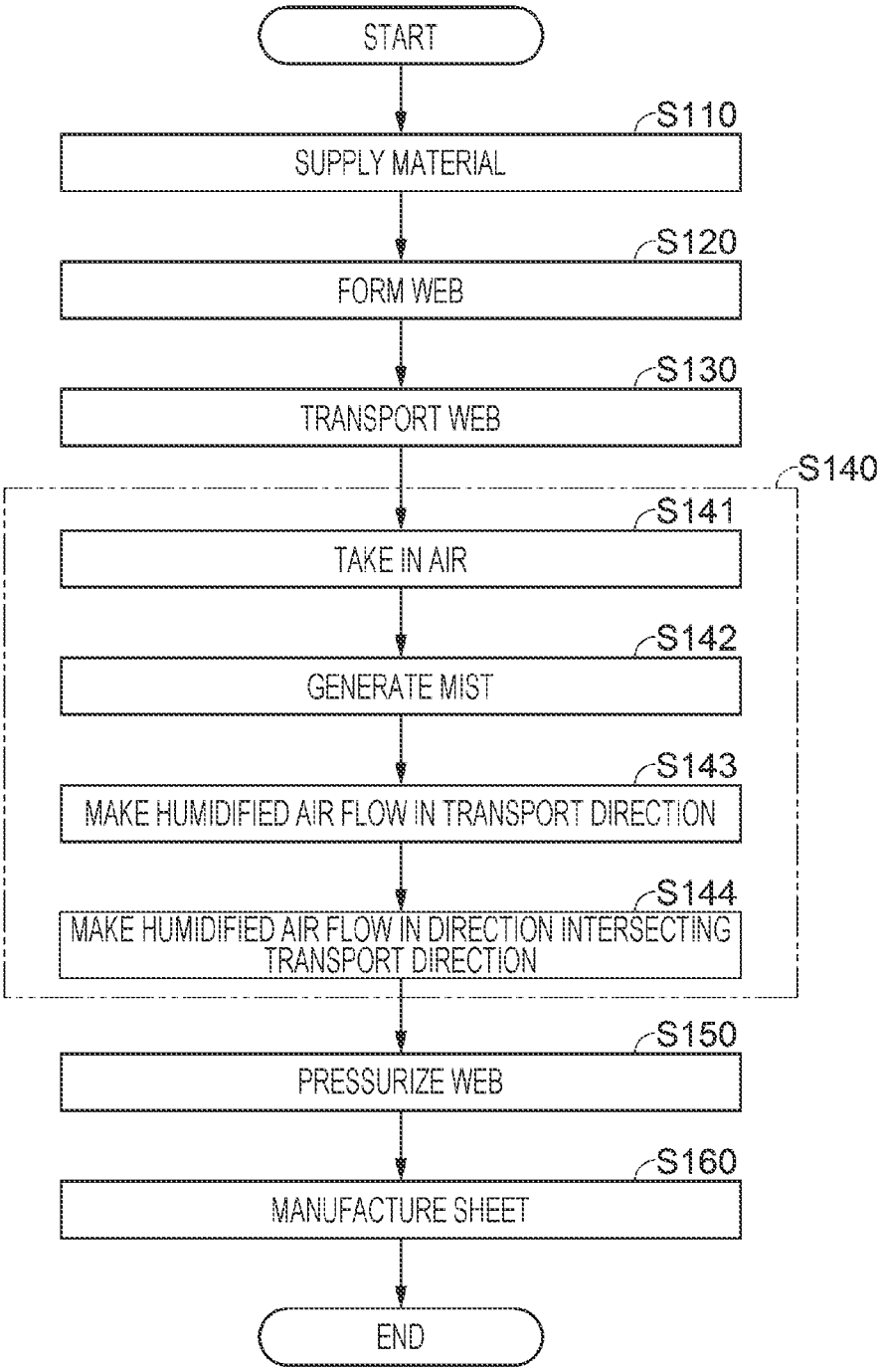
FIG. 4 is a flowchart illustrating a sheet manufacturing method.

Next, a sheet manufacturing method using the sheet manufacturing apparatus 1 according to the present embodiment will be described with reference to the steps illustrated in the flowchart of FIG. 4. The configuration of the sheet manufacturing apparatus 1 that implements the sheet manufacturing method is as described above with reference to FIGS. 1 to 3. In addition, each step is executed by controlling each section by the control section.

In the sheet manufacturing apparatus 1, a material such as a fiber is supplied by the supply section 10 (S110). In the sheet manufacturing apparatus 1, the supplied material is cut by the crushing section 11, defibrated by the defibration section 20, sorted by the sorting section 40, mixed with the binder by the mixing section 50, and accumulated by the air flow of the suction mechanism 76 of the accumulation section 60 to form the web W (S120).

The web transport section 80 of the sheet manufacturing apparatus 1 suctions the web W from above by the suction mechanism 83 via the second mesh belt 81, and transports the web W in the transport direction T by the plurality of rollers 82 (S130).

Specifically, the step (S140) of humidifying the web W by the humidification section 90 of the sheet manufacturing apparatus 1 includes the following steps.

The air duct 95 of the humidification section 90 takes in the air A from the air intake port 95*a* (S141), and makes the air A flow toward the water surface of the water L stored in the tank 96 along the air flow path F1 in the direction opposite to the transport direction T of the web W. The mist M is generated from water L by the piezoelectric vibrator 97 disposed at the bottom portion of the tank 96 (S142).

The humidified air MA containing the air A and the mist M is made to flow along the first flow path F2 in the transport direction T by the first duct 92 provided above the tank 96 (S143).

After that, the humidified air MA is made to flow along the second flow path F3 in the upward direction, which is the direction intersecting the transport direction T, by the second duct 93 coupled to the first duct 92 (S144), exhausted from the exhaust port 93*a* to the web W, and humidified.

Next, the sheet forming section 110 pressurizes the web W humidified by the humidification section 90 (S150) to form the sheet S. The sheet forming section 110 may form the sheet S by performing at least one of heating and pressurizing treatment on the web W. At this time, the sheet S has a continuous sheet shape.

A continuous sheet-shaped sheet S is cut by the cutting section 120 to manufacture a cut-form sheet S having a predetermined size (S160).

As described above, in the humidifying step, the humidified air MA flows in the transport direction T and then flows in the direction intersecting the transport direction T to humidify the web W. The transport direction T and the direction intersecting the transport direction T are directions of bending each other. By the humidifying step, it is possible to suppress the fibers and the like that fell into the humidification section 90 from reaching the tank 96 against the flow of the bending humidified air MA.

In particular, it is possible to suppress the movement of the fibers and the like in the direction opposite to the transport direction T against the flow of the humidified air MA in the transport direction T. The direction opposite to the transport direction T is a direction toward the tank 96 and is a horizontal direction. There is no external force acting to move the fibers and the like in the direction opposite to the transport direction T.

As a result, it is possible to suppress the fibers and the like from reaching the tank 96 and being mixed into the water L, and suppress the generation of mold, germs, and the like.

In the case of the sheet manufacturing method using the sheet manufacturing apparatus 1, as in the case of the sheet manufacturing apparatus 1 described above, the humidification section 90 illustrated in FIGS. 1 to 3 may be configured to be symmetrical with respect to the front-rear direction. That is, in the case of this configuration, the position of the exhaust port 93*a* is shifted in the direction opposite to the transport direction T with respect to the position of the tank 96.

Further, in the case of this configuration, the air duct 95 takes in the air A from the air intake port 95*a* positioned on the rear surface and makes the air A flow along the air flow path F1 in the transport direction T of the web W. The first duct 92 makes the humidified air MA flow along the first flow path F2 going in the direction opposite to the transport direction T. After that, the second duct 93 makes the humidified air MA flow along the second flow path F3 going in the upward direction, which is the direction intersecting the direction opposite to the transport direction T. The directions of the air flow path F1 of the air duct 95 and the first flow path F2 of the first duct 92 are opposite to those in FIGS. 2 and 3.

In the case of this configuration as well, similarly to the case of the humidification section 90 illustrated in FIGS. 1 to 3, it is possible to suppress the fibers and the like from reaching the tank 96 and being mixed into the water L, and suppress the generation of mold, germs, and the like.

According to the above embodiments, in the sheet manufacturing apparatus 1, the position of the exhaust port 93*a* is shifted in the transport direction T or the direction opposite to the transport direction T with respect to the position of the tank 96. The humidified air MA generated in the tank 96 by the piezoelectric vibrator 97 flows in the transport direction T or the direction opposite to the transport direction T, and then flows in the direction intersecting the transport direction T or the direction opposite to the transport direction T, and is exhausted from the exhaust port 93*a* to humidify the web W.

As a result, it is possible to suppress the fibers and the like from reaching the tank 96 and being mixed into the water L, and suppress the generation of mold, germs, and the like.

What is claimed is:

1. A sheet manufacturing apparatus comprising:

an accumulation section that accumulates a material containing fibers by an air flow to form a web;

a transport section that transports the web in a first direction;

a humidification section that humidifies the web; and a pressurization section that pressurizes the web humidified by the humidification section and compresses the web into a sheet shape, wherein the humidification section includes an intake port that takes in air, a tank that stores water, a mist generation section that generates mist from the water, and an exhaust port that exhausts the mist and the air toward the web, and a position of the exhaust port is shifted in the first direction or a second direction opposite to the first direction with respect to a position of the tank.

2. The sheet manufacturing apparatus according to claim 1, wherein the humidification section has a duct which is provided between the tank and the exhaust port and through which the mist and the air pass.

3. The sheet manufacturing apparatus according to claim 2, wherein the duct includes a first duct provided above the tank and extending in the first direction or the second direction, and a second duct provided between the first duct and the exhaust port and extending in a third direction intersecting the first direction or the second direction.

4. The sheet manufacturing apparatus according to claim 3, further comprising:

a tray positioned below the second duct.

5. The sheet manufacturing apparatus according to claim 3, wherein the first direction and the second direction are horizontal directions, and the third direction is a vertical direction.

6. The sheet manufacturing apparatus according to claim 1, wherein the humidification section is positioned below the transport section, and the exhaust port is provided at a position facing the transport section from below.

* * * * *